US007458233B2

(12) United States Patent
Tcharnotskaia

(10) Patent No.: US 7,458,233 B2
(45) Date of Patent: Dec. 2, 2008

(54) MIXED JEWELRY SET

(76) Inventor: Guelena Eduardovna Tcharnotskaia, Apajatie 50, Rovaniemi (FI) FI-96800

( * ) Notice: Subject to any disclaimer, the term of this patent is extended or adjusted under 35 U.S.C. 154(b) by 0 days.

(21) Appl. No.: 10/524,909

(22) PCT Filed: May 19, 2003

(86) PCT No.: PCT/RU03/00221

§ 371 (c)(1),
(2), (4) Date: Feb. 17, 2005

(87) PCT Pub. No.: WO03/103435

PCT Pub. Date: Dec. 18, 2003

(65) Prior Publication Data

US 2006/0150675 A1 Jul. 13, 2006

(30) Foreign Application Priority Data

Aug. 19, 2002 (RU) ..... 2002121961

(51) Int. Cl.
*A44C 15/00* (2006.01)

(52) U.S. Cl. ..... 63/3; 63/38; 63/40

(58) Field of Classification Search ..... 63/3, 63/3.1, 33, 34, 35, 38, 40, 41
See application file for complete search history.

(56) References Cited

U.S. PATENT DOCUMENTS 263,095 A * 8/1882 Ballou ..... 59/80

(Continued)

FOREIGN PATENT DOCUMENTS

DE 2724712 A1 12/1978

(Continued)

*Primary Examiner*—Jack W. Lavinder
(74) *Attorney, Agent, or Firm*—Paul & Paul

(57) ABSTRACT

The invention is intended for use in jewelry industry. A composite set of jewelry ornaments contains decorative elements in the form of settings with stones and a connector with a lock, characterized in that it contains tubular elements and tubular elements in combination with settings with stones. The tubular elements are provided with one or more cross through openings. The settings are provided with eyeholes or through mounting openings. The ratio of length to diameter of tubular elements is in the range of from 1/1 to 30/1. All components of the set are made of precious metals or alloys thereof or plated with precious metals or alloys thereof. Tubular elements may be arcuate or bent at an angle, S-shaped, faceted, e.g., tri-, tetra-, penta-, hexahedral or dome-shaped, or in the form of paraboloid of revolution, or in the form of a series of spheres having equal or different diameters with polished or mat surface or with a combination of both types of surface states, or with shaped surface, e.g. corrugated or ornamental. Tubular elements are decorated with natural or artificial precious or semi-precious or ornamental stones taken separately or together or in different combinations. Settings with stones contain natural or artificial precious or semi-precious stones, or ornamental stones taken separately or together, or in different combinations. It is possible to decorate tubular elements by chasing or with an ornament executed with the use of the partitioned enamel technique. The settings with stones contain natural or artificial precious or semi-precious, or production stones taken separately or together or in different combinations. The connector is made in the form of a chain, or a purl, or a thread. The increase in useful qualities by virtue of widening the variability of the constructive solution is provided.

20 Claims, 8 Drawing Sheets

U.S. PATENT DOCUMENTS

| | | | | | |
|---|---|---|---|---|---|
| 430,295 | A | * | 6/1890 | Matheson | 63/3 |
| 3,192,738 | A | | 7/1965 | Charles et al. | |
| 4,305,262 | A | * | 12/1981 | Ferrara | 63/29.1 |
| 4,712,389 | A | * | 12/1987 | Innis | 63/1.14 |
| 5,694,791 | A | * | 12/1997 | Esposito | 63/3 |
| 6,220,010 | B1 | | 4/2001 | Gomez | |
| 2003/0136149 | A1 | * | 7/2003 | Logan et al. | 63/35 |

FOREIGN PATENT DOCUMENTS

| | | | |
|---|---|---|---|
| EP | 0105995 | A1 | 4/1984 |
| EP | 0462077 | A1 | 12/1998 |
| FR | 2495449 | | 12/1980 |
| FR | 2588166 | | 10/1987 |
| FR | 2781990 | | 2/2000 |
| GB | 2069817 | A | 9/1981 |
| RU | 2060022 | C1 | 5/1996 |
| WO | WO 01/52683 | A1 | 7/2001 |

* cited by examiner

MIXED JEWELRY SET

FIELD OF THE INVENTION

The invention relates to jewelry industry, in particular, to decorative articles of jewelry suitable for wearing, for example, on the neck, on the hand, etc.

BACKGROUND OF THE INVENTION

A composite jewelry decorative article in the form of a volute spring with detachable decorative elements having eyeholes or bends for fastening onto the spring is disclosed in RU 2117439 C1, A 44 C 9/00, Aug. 20, 1998.

The shortcoming of this decorative article is the limited area of use and moderate decorative properties.

The closest to the claimed invention in technical essence is a composite jewelry article disclosed in FR 2588166 A1, A 44 C 13/00, Apr. 10, 1987, comprising a motif with precious stones, which is mounted in the body of the jewel by easily removable fastening means.

The shortcoming of said composite jewelry article is modest decorative properties and, as a consequence, a low useful quality.

DISCLOSURE OF THE INVENTION

It is an object of the present invention to create a jewelry decorative article with improved useful quality by virtue of widening the variety of constructive solutions that is to minimize if not fully exclude the possibility of the emergence of two completely identical jewelry decorative articles.

The technical result of the invention is the increase in useful quality by virtue of widening the variety of constructive solutions.

This technical result is achieved in a composite set of jewelry ornaments containing settings with stones as decorative elements and a connector with a lock. In distinction to the known composite jewel it further comprises tubular elements and tubular elements in combination with settings with stones; said tubular elements are provided with one or more cross through openings, said settings are provided with eyeholes or with through mounting openings; the ratio of length to diameter for tubular elements is in the range of 1/1-30/1 and all components of the ornament are made of precious metals or alloys thereof or plated with precious metals or alloys thereof.

Tubular elements may be curved, e.g. bent in the form of an arch or at an angle, S-shaped; faceted, e.g., tri-, tetra-, penta-, hexahedral or dome-shaped, or in the form of paraboloid of revolution, or in the form of a series of spheres having equal or different diameter. Tubular elements may have polished or mat outer surface or a combination of both types of surfaces, or a shaped surface, e.g. corrugated or ornamental. Tubular elements may be decorated with natural or artificial precious or semi-precious, or ornamental stones separately or together or in different combinations. Settings with stones contain natural or artificial precious or semi-precious stones, or production stones taken separately or together, or in different combinations, singly or in groups or as rosettes with stones in different combinations according to the types of stones or their dimensions; said settings have mounting openings and the connector is made in the form of a chain, a purl, or a thread.

It is well known that existing fashionable jewelry ornaments are, in general, custom-made goods and often inimitable and unique. This fact can be easily explained since a wearer (more precisely, a lady who wears an ornament) feels an extremely strong psychological discomfort when she realizes that her ornament is completely identical to that worn by another lady.

In applicant's opinion the presented technical solution meets the criteria of novelty and inventive step and the technical result achieved—the possibility of practically infinitely varying the combinations of decorative elements in the ornament and thereby creating practically inimitable in external appearance or in constructive solution jewelry ornaments—imparts the exceptionally high useful quality to the claimed technical solution.

Besides, the proposed technical solution may be available to the general public. Depending on the income of the user the decorative elements may be purchased gradually, the least one by one.

In fact the proposed technical solution—a composite set of jewelry ornaments containing decorative elements of different types, forms and dimensions and means of connecting them in a composition is a self-composed system which makes possible the creation of a broad spectrum of different inimitable articles, which design and decorative attractiveness are limited only by the user's fantasy.

The decorative elements (GelenKey) of the claimed composite set of jewelry ornaments represent tubular elements, which in addition to the central axial through opening have one, two or more cross through openings made at the edges and/or in the middle of said tubular element. The dimensions and form of tubular elements may be different and they are bounded only by production potentialities and reasonable limits. The ratio of diameter (a transverse dimension) to length is from 1/1 to 1/30. Tubular elements may be straight, curved in the form of an arc or bent at an angle, e.g. 135°, or of S-shaped right- and left-oriented form. Tubular elements may be dome-shaped, in the form of a paraboloid of revolution, in the form of a set of spheres having equal or different diameter. Tubular elements may be faceted, e.g., tri-, tetra-, penta-, hexahedral, etc. Tubular elements may be encrusted with stones, decorated with chasing or partitioned enamel singly, together or in arbitrary combinations. The surface of tubular elements may be polished, mat, smooth or corrugated or may have all states of surfaces in arbitrary combinations.

As a material of tubular elements the following may be used: gold, silver, platinum metals, alloys of precious metals, as well as ivory, nacre, pearls, amber, wood, e.g. sandal wood.

Tubular elements may be made of non-precious metals or alloys coated or plated with precious metals or alloys thereof and also may be bimetallic.

The decorative elements of the claimed composite set of jewelry ornaments are settings with stones. Said settings have eyeholes or through mounting openings.

As a material of settings the following may be used: gold, silver, platinum metals, alloys of precious metals, ivory, pearls, nacre, amber, wood, e.g. sandal wood.

The settings may be made of precious metals or alloys thereof coated or plated with precious metals or alloys thereof.

The settings may comprise a single stone, rosettes of stones of equal or different dimensions, forms, types and facet of stones in various combinations.

The stones used are natural precious stones, e.g. diamonds, emeralds, sapphires, topazes, etc., natural semi-precious stones, e.g. rock crystal, lazurite, malachite, etc., natural ornamental stones, e.g. jasper, onyx, selenite, fluorite, etc., organic stones, e.g. pearl, nacre, amber, wood, etc.

As decorative stones the following may be used: synthetic precious and semi-precious stones, e.g. fianites, zirconites, etc., as well as organic stones, e.g. pearl, nacre, amber, etc. Facet of stones may be in the form of a square, baguette, octagon, shield, trapezium, dome, etc. as well as a diamond one, in the form of a rose, Ceylon, wedged, an emerald one, stepped, in the form of a double or high cabochon, etc.

A connector may represent chains of different plaiting, a purl or a thread made of precious metals or alloys thereof may be used.

Connectors are provided with locks, which types and form are unspecified, however, they provide a secure locking of decorative elements on said connector. Carbine locks, locks in the form of double carbine, screw locks, etc. may be used. The number of identical elements in the claimed composite set may be even or odd or any one within reasonable limits.

Decorative elements are strung on the connector in an arbitrary way, more often on the principle of mirror symmetry about the vertical axis.

In spite of the limited number of types and forms of decorative elements in the claimed composite set of jewelry ornaments the possibilities of "constructing" decorative articles are practically unbounded and, as it has been already mentioned, depend only on the components of set and user's fantasy.

The ornament (GelenKey) is assembled as follows.

First the necessary number of decorative elements of certain types and the corresponding connector are selected and then the jewelry ornament is assembled in accordance with the user's taste and fantasy. It would appear natural that the ornament assembled in such a manner may be worn on the neck, on the head (e.g. as a diadem), on the hand and in general on every part of the body.

BRIEF DESCRIPTION OF THE DRAWINGS

The essence of the claimed invention can be illustrated by drawings.

DETAILED DESCRIPTION OF THE EMBODIMENTS

Figure 1:
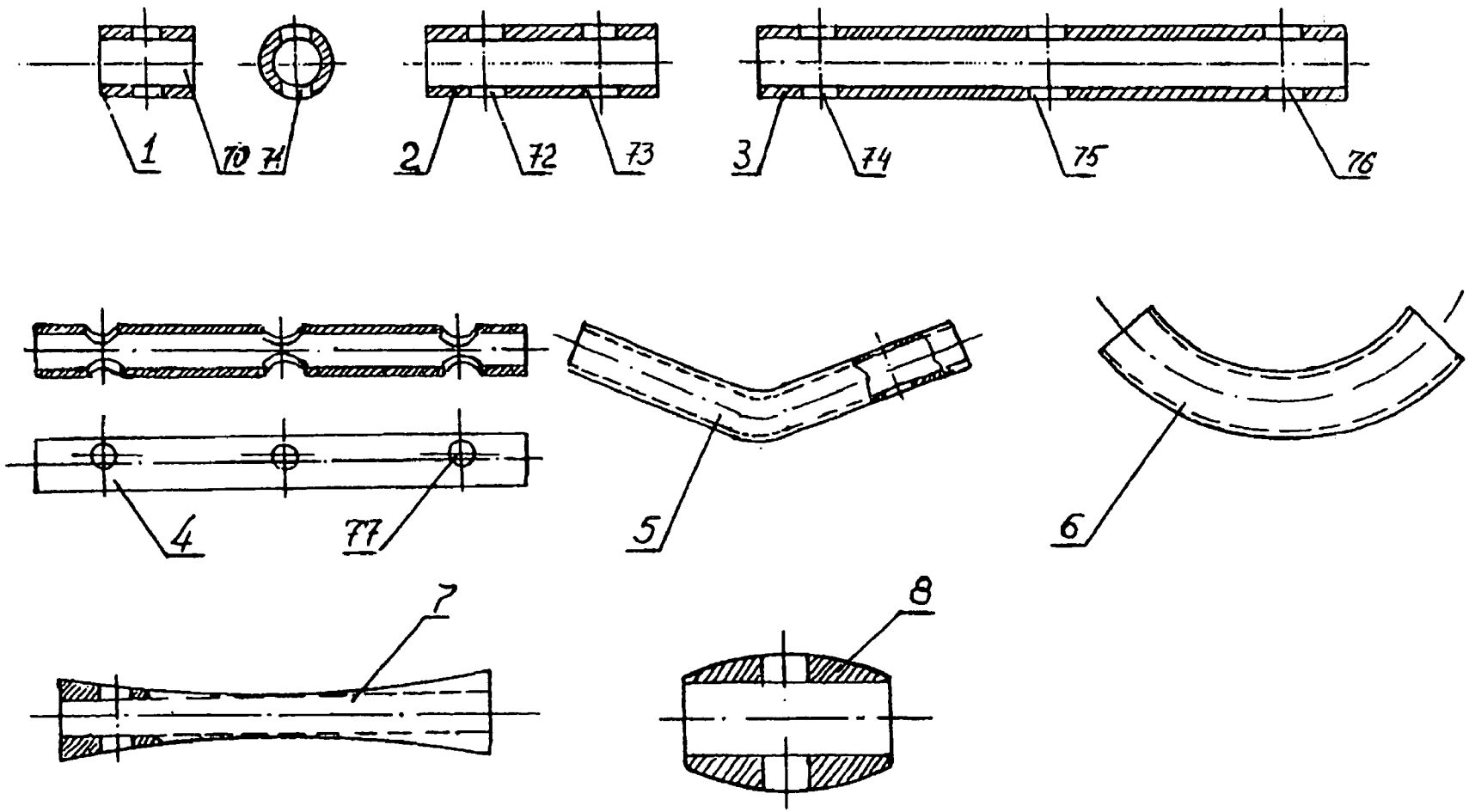
FIG. 1 shows variants of tubular decorative elements.
Figure 2:
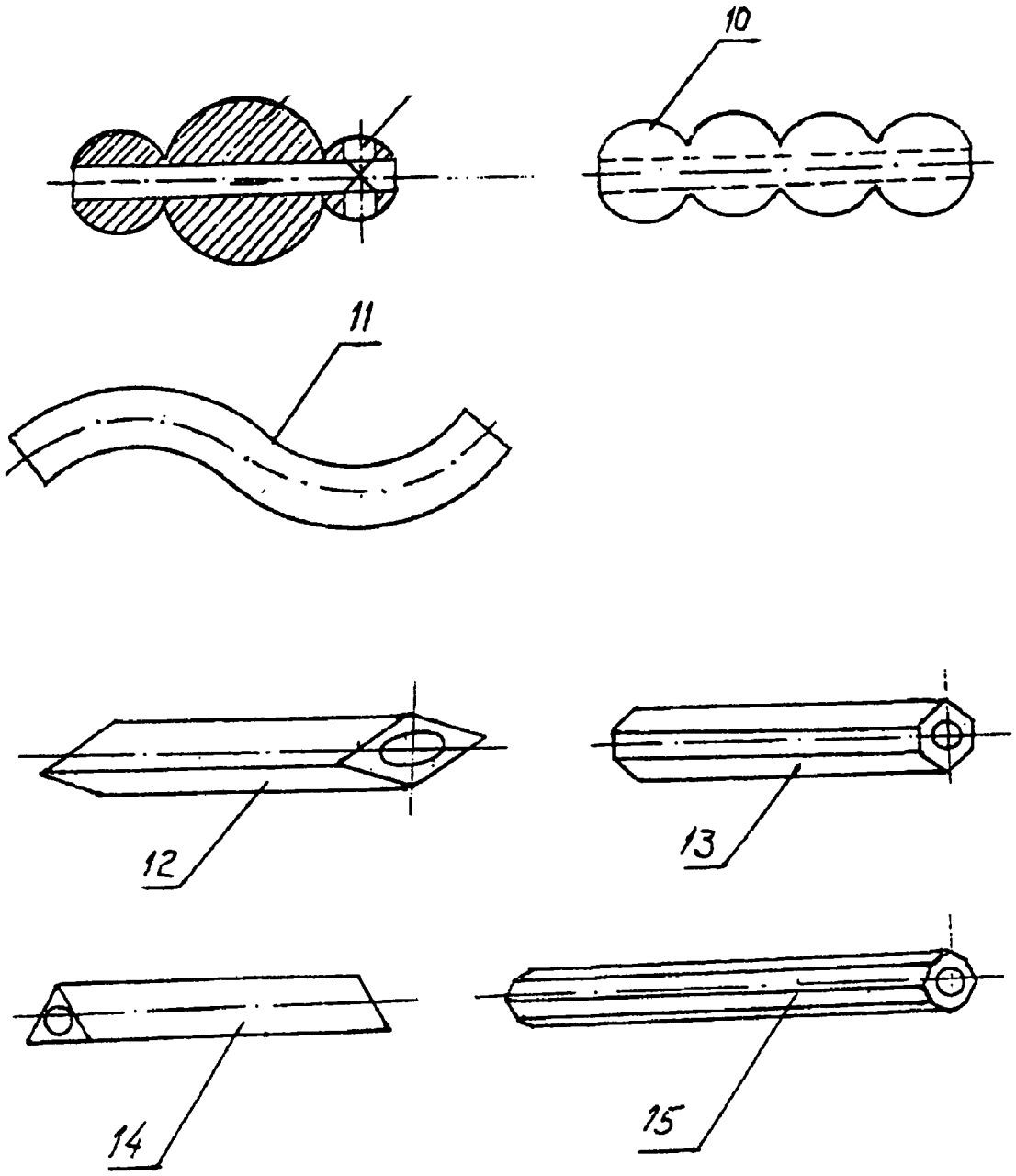
FIG. 2 shows variants of tubular decorative elements of different types.

Tubular decorative elements (see FIG. 1) represent articles 1, 2, 3 and 4 having longitudinal 70 and cross 71, 72, 73, 74, 75, 76, 77, etc. through openings. The tubular decorative elements may be bent at an angle 5, or arcuate 6, in the form of hyperboloid of revolution 7, dome-shaped and referring to FIG. 2—as conjugated spheres having different 9 and equal diameter 10, S-shaped 11, having the rhombic 12, hexagonal 13, triangular 14, octagonal 15 cross-section.

Figure 3:
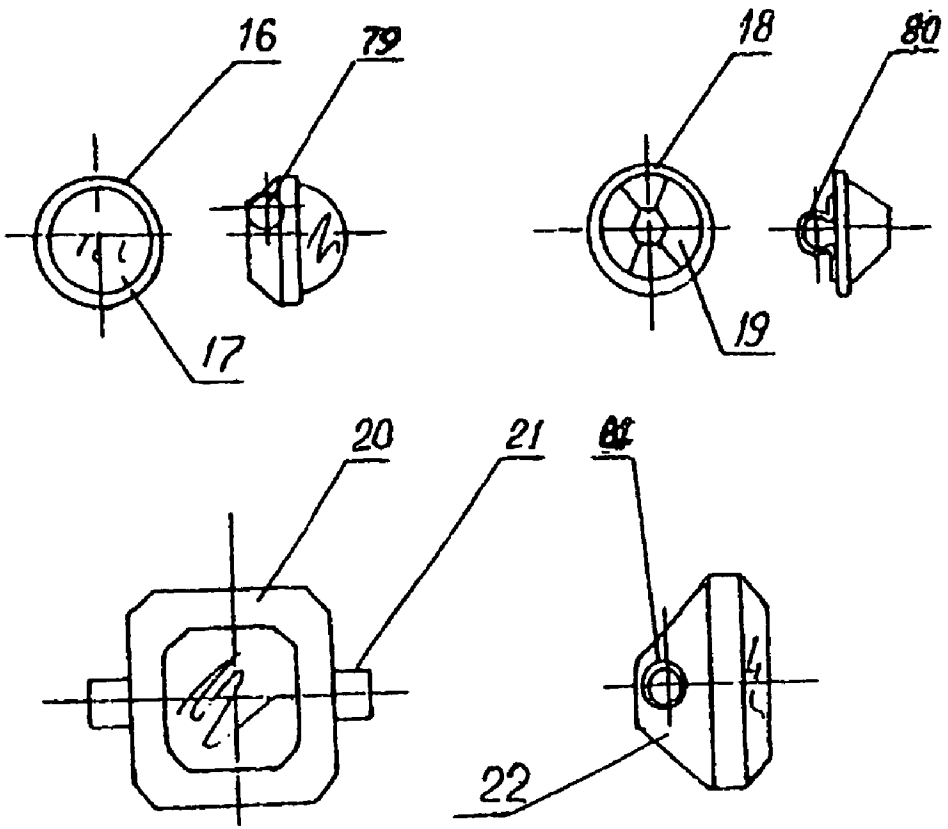
FIG. 3 shows variants of settings with stones and means for mounting said settings on the connector.

Settings with stones 16-17, 18-19 (see FIG. 3) have the through mounting opening 79 with eyes 80. The setting 20, 22 is furnished with the tubular decorative element 21, which is pressed into the mounting opening 81.

The surface of tubular decorative elements 23, 24, 25, 26, 27, 28 and 29 (see FIG. 4) is polished; the surface of tubular decorative elements 31, 36, 37 and 38 is mat, the surface of the tubular motif 30 is of mixed type (polished and mat); tubular decorative elements 32, 33 and 34 have the surface decorated with the ornament made with use of the partitioned enamel technique; tubular decorative element 35 is made with chasing, the ornament with the use of the partitioned enamel technique and decorated with stones. Tubular decorative elements 36, 37, 38, 39 and 40 are decorated with stones (in particular, with diamonds, sapphires and rubies).

Figure 5:
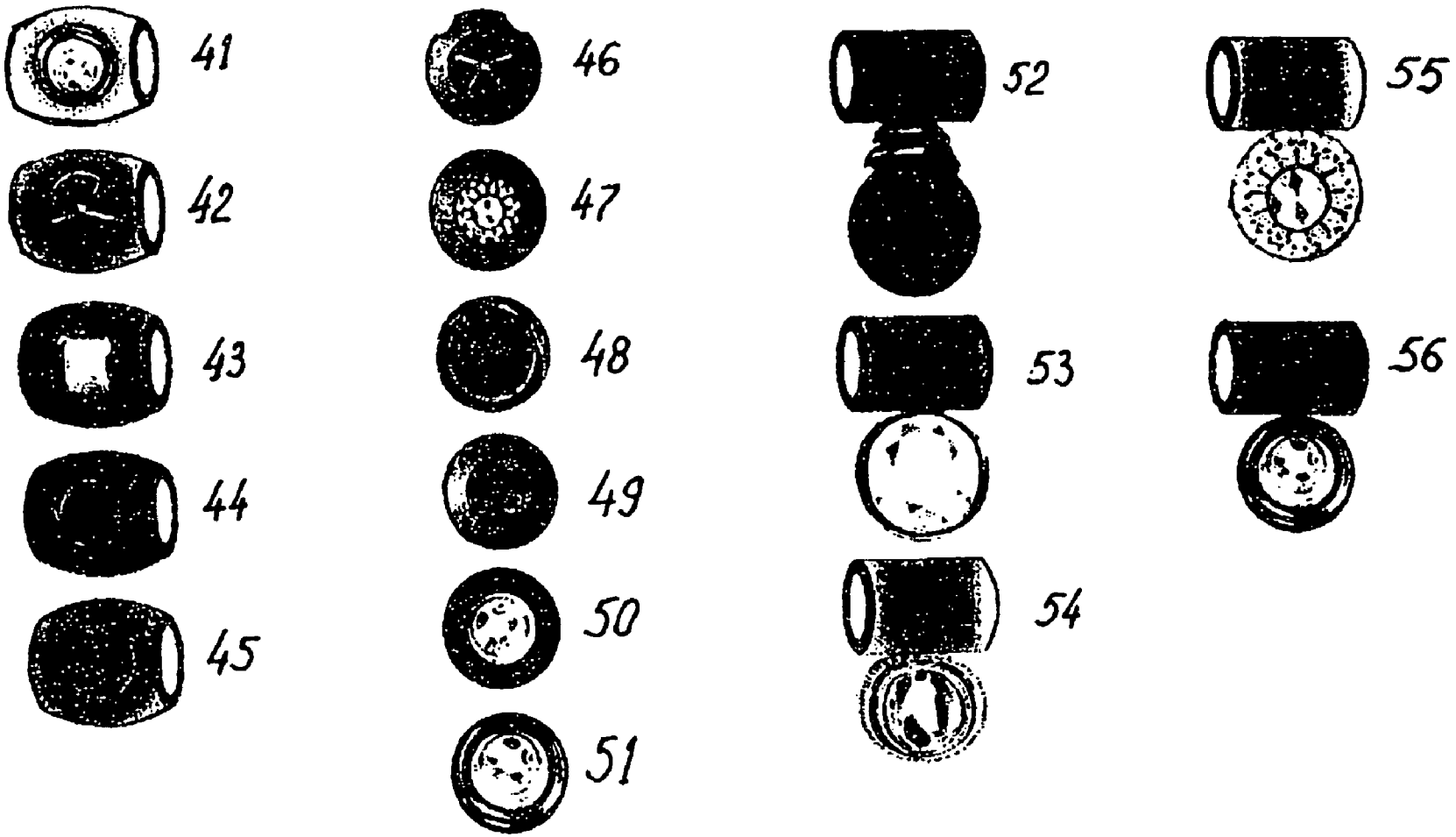
FIG. 5 shows variants of tubular decorative elements decorated with stones (41-45), of settings with stones (46-51) and the combinations of tubular decorative elements with settings with stones (52-56).

Dome-shaped tubular decorative elements (see FIG. 5) are decorated with sapphires 41, the partitioned enamel in combination with stones 42, topazes 43, cabochons of precious stones 44, 45. The settings are decorated with partitioned enamel in combination with stones 46, rosettes with precious stones 47 and double cabochons 48, 49, 50 and 51. Tubular decorative elements 52, 53, 54, 55 and 56 are made in combination with cabochons, faceted stones and rosettes with precious stones.

Figure 6:
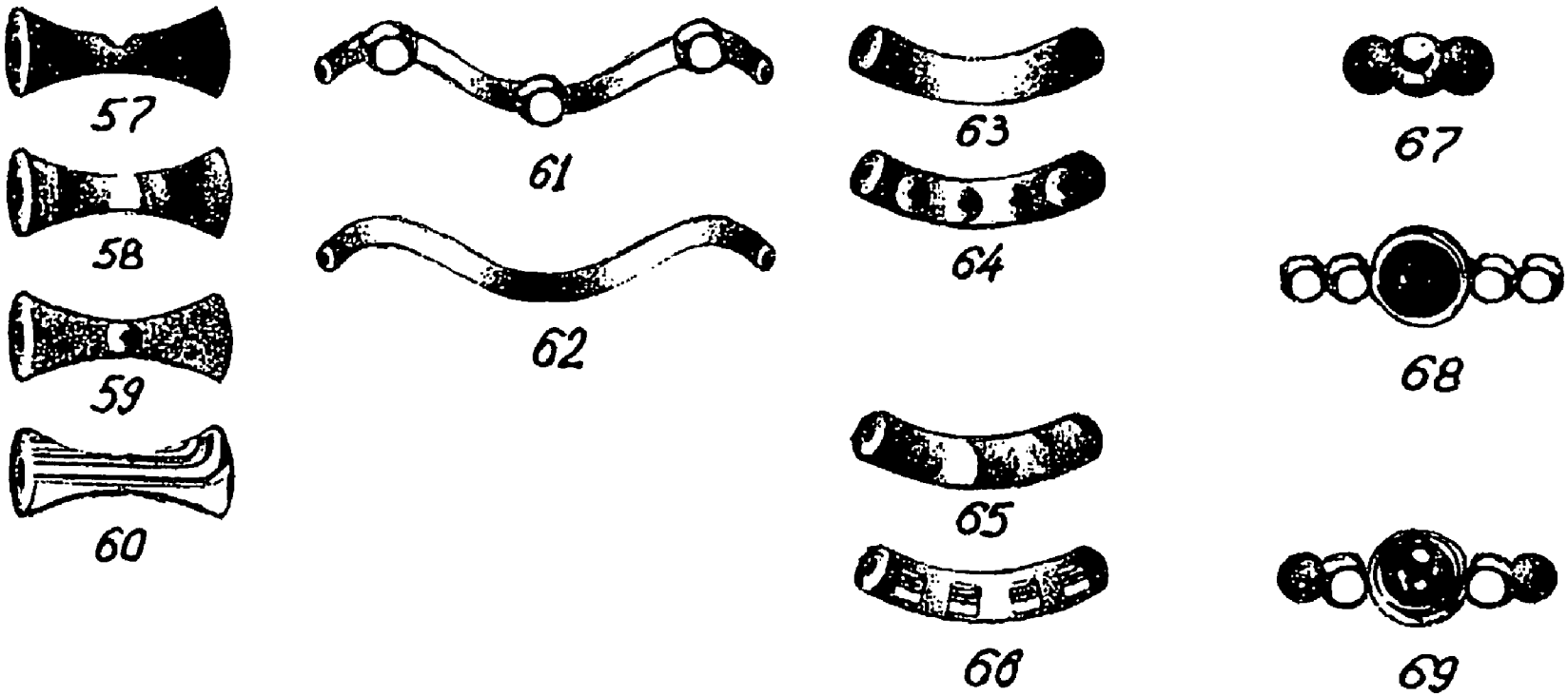
FIG. 6 shows variants of tubular decorative elements and the ornament thereof.

The similar ornament have tubular decorative elements (see FIG. 6) made in the form of hyperboloid of revolution: 57—with polished surface, 58—with combined surface (polished and mat), 59—with a stone ornament and 60—with the ornament made with the use of the partitioned enamel technique. The tubular S-shaped decorative elements are made as follows: 61—is decorated with emerald, 62—with polished surface; the tubular arcuate decorative elements are made as follows: 63—with polished surface, 64—is decorated with stones, 65—with a combined surface state, 66—is decorated with the ornament made with the use of the partitioned enamel technique. The tubular decorative elements in the form of spheres 67, 68 and 69 are decorated with stones.

It should be noted that the variety of embodiments of both the tubular decorative elements themselves and connectors with locks is not exhausted by the foregoing illustrative examples and the description and disclosure of their essence may be continued by enumerating types of ornaments made of stones, constructions of locks, etc.

It is obvious that just as the number of variants of constructive varying of the ornament design "in the assembly" is infinite, so infinite will be the number of embodiments and ornaments of decorative elements of the claimed composite set of jewelry articles.

For better understanding the invention can be illustrated but not exhausted by the following examples of concrete embodiments.

EXAMPLE 1

The composite jewelry ornament is assembled on the connector (FIG. 7) by positioning the decorative elements in mirror symmetry about the vertical axis in the following order: one tubular decorative element, central in the composition, (FIG. 4, 36) made of pure gold decorated with diamonds (the connector is passed through the longitudinal opening in the body of the decorative element), next one decorative element on each side—the setting made of white gold with golden topaz (FIG. 5, 51), next one tubular decorative element made of white gold decorated with diamond (FIG. 4, 37) on each side, next one setting (FIG. 5, 51) on each side, next one tubular decorative element made of white gold decorated with diamonds (FIG. 4, 38), next one setting on each side (FIG. 5, 51), next one symmetric common tubular decorative element (FIG. 4, 36), wherein the ends of the connector are laced from butt-ends of the tubular decorative element and brought out from the end cross openings in the wall thereof; and finally—one setting (FIG. 5, 51) on each side. The jewelry article assembled in such a way is presented in FIG. 7.

EXAMPLE 2

Figure 4:
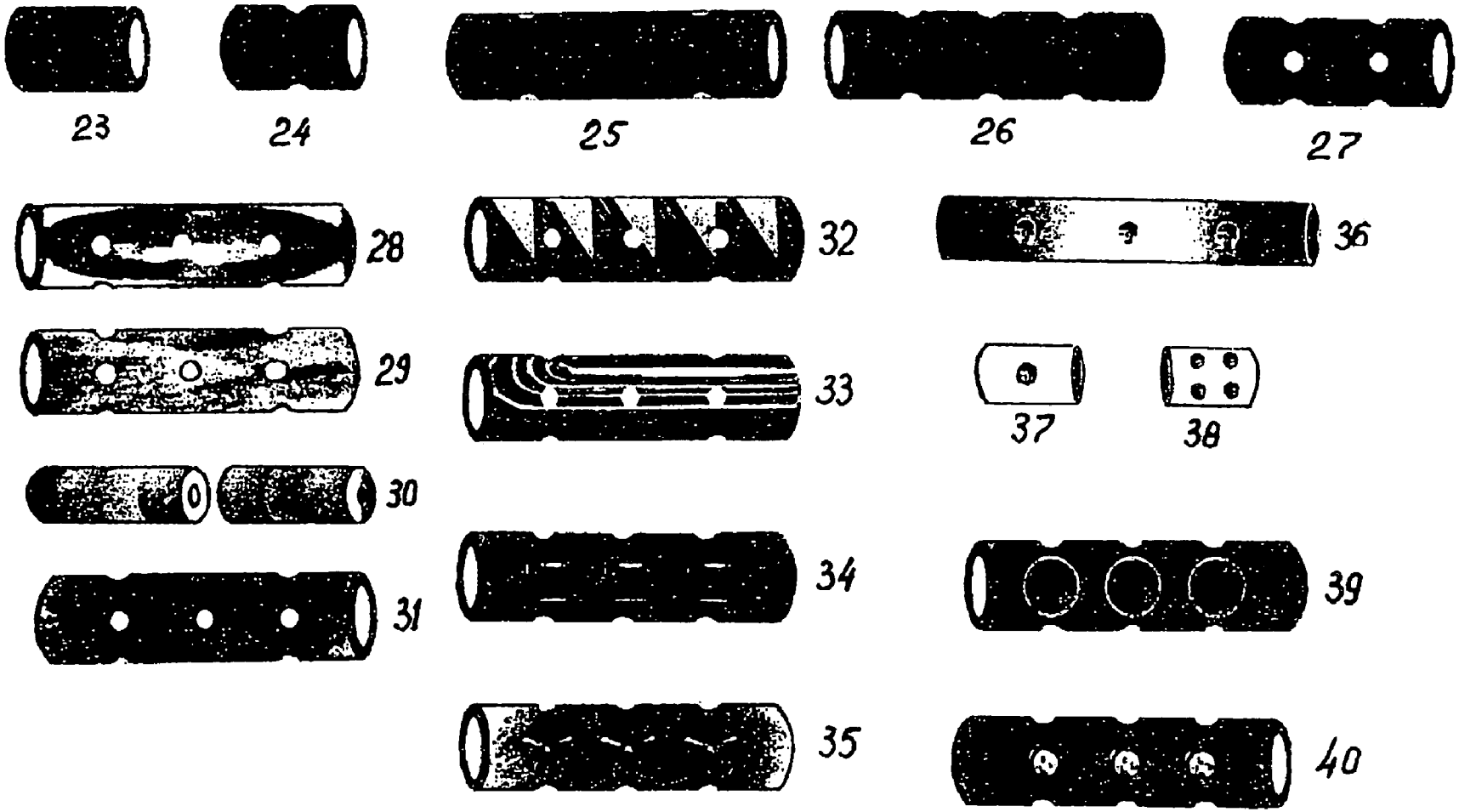
FIG. 4 shows variants of tubular decorative elements treated differently or having different surface state and ornament thereof.

The composite jewelry ornament is assembled on the connector by positioning the decorative elements in mirror symmetry about the vertical axis in the following order: two tubular decorative elements (FIG. 4, 36) made of pure gold decorated with diamonds (the connector is passed through the extreme cross opening in each decorative element), next one tubular decorative element made of white gold decorated with diamonds on each side (FIG. 4, 38), next four settings made of white gold with golden topaz on each side (FIG. 5, 51), next one tubular decorative element made of white gold decorated with diamond on each side (FIG. 4, 37). The jewelry article assembled in such a way is presented in FIG. 7.

Figure 7:
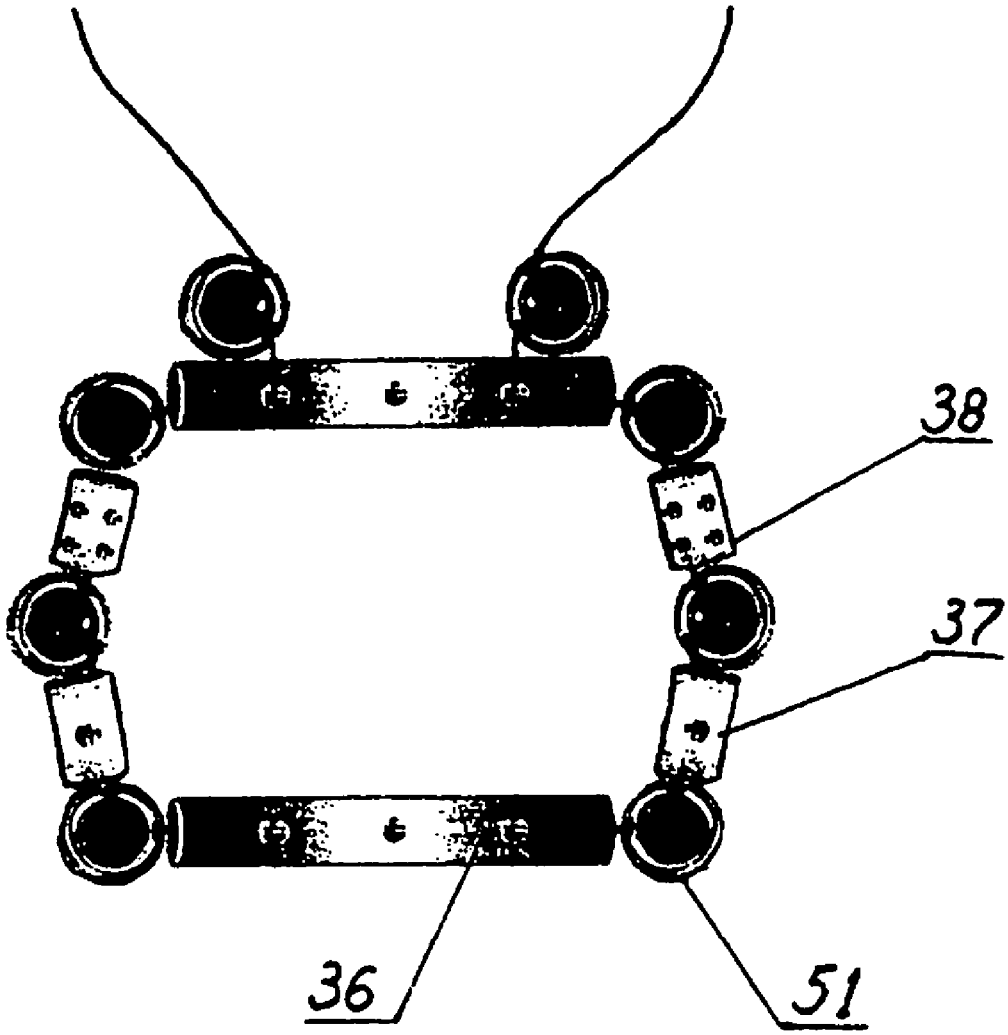
FIGS. 7 and 8 show possible variants of the jewelry ornament assembled from the similar decorative elements.
Figure 8:
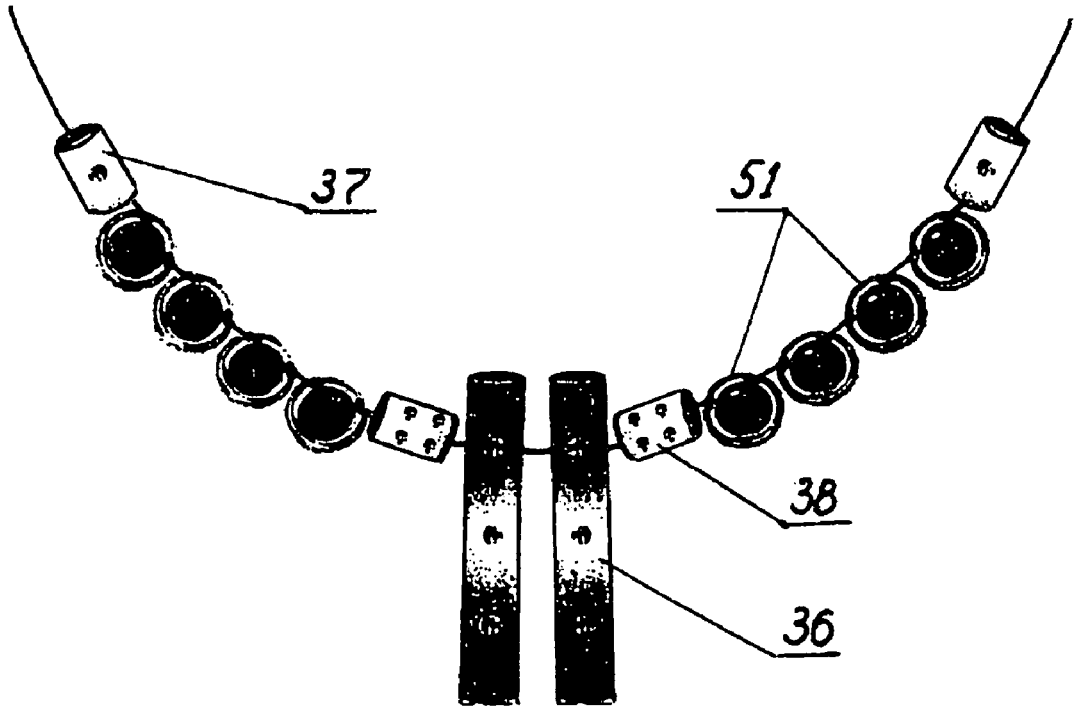

The comparison of jewelry articles given in FIGS. 7 and 8 shows clearly that with the use of the similar types and the same number of decorative elements distinctly different jewelry articles may be assembled.

INDUSTRIAL APPLICABILITY

The industrial applicability of the claimed invention is clear from the foregoing description of embodiments thereof. The subject mater of the invention has a high useful quality by virtue of widening the variety of the constructive solution.

The invention claimed is:

1. A composite set of jewelry ornaments comprising:

(a) a connector in the form of a thread or a chain;

(b) a lock, (c) a first tubular decorative element having butt-ends, the ratio of length to diameter of the first tubular decorative element being in the range of from 1/1 to 30/1, the first tubular decorative element being provided with a central axial through opening and with one or more cross-through openings to pass the connector, and (d) decorative elements in the form of settings with stones, all decorative elements being strung on the connector, the connector extending through butt-ends of the first tubular decorative element into the central axial through opening and extending out through the cross openings in the wall thereof;

wherein all components of the set are made of precious metals or alloys thereof or plated with precious metals or alloys thereof.

2. A composite set of jewelry ornaments according to claim 1, characterized in that the tubular elements are bent in the form of an arc.

3. A composite set of jewelry ornaments according to claim 1, characterized in that the tubular elements are bent at an angle.

4. A composite set of jewelry ornaments according to claim 1, characterized in that the tubular elements are S-shaped.

5. A composite set of jewelry ornaments according to claim 1, characterized in that the tubular elements are faceted, for example, they may be tri-, tetra-, penta-, hexahedral.

6. A composite set of jewelry ornaments according to claim 1, characterized in that the tubular elements are dome-shaped.

7. A composite set of jewelry ornaments according to claim 1, characterized in that the tubular elements are made in the form of paraboloid of revolution.

8. A composite set of jewelry ornaments according to claim 1, characterized in that the tubular elements are in the form of a series of spheres having equal or different diameter.

9. A composite set of jewelry ornaments according to claim 1, characterized in that the tubular elements are made with polished or matte outer surface or with a combination of both types of surface state.

10. A composite set of jewelry ornaments according to claim 1, characterized in that the tubular elements are made with polished outer surface.

11. A composite set of jewelry ornaments according to claim 1, characterized in that the tubular elements are made with matte outer surface.

12. A composite set of jewelry ornaments according to claim 1, characterized in that the tubular elements are made with a combination of both polished and matte states of surface.

13. A composite set of jewelry ornaments according to claim 1, characterized in that the tubular elements are made with shaped surface.

14. A composite set of jewelry ornaments according to claim 1, characterized in that the tubular elements are decorated with natural or artificial precious, semiprecious or ornamental stones taken separately or together or in different combinations.

15. A composite set of jewelry ornaments according to claim 1, characterized in that the tubular elements are decorated by chasing.

16. A composite set of jewelry ornaments according to claim 1, characterized in that the tubular elements are decorated with an ornament executed with the use of the partitioned enamel technique.

17. A composite set of jewelry ornaments according to claim 1, characterized in that the settings with stones contain natural or artificial precious, semiprecious, ornamental stones taken separately or together or in various combinations.

18. A composite set of jewelry ornaments according to claim 1, characterized in that the connector is made in the form of a chain, a purl or a thread.

19. A composite set of jewelry ornaments according to claim 1, characterized in that the tubular elements are made with a corrugated surface.

20. A composite set of jewelry ornaments comprising:

(a) a connector in the form of a thread or a chain;

(b) a lock, (c) tubular decorative elements, the ratio of length to diameter of tubular elements being in the range of from 1/1 to 30/1, the tubular elements being provided with a central axis through opening and one or more cross-through openings to pass the connector, the connector extending from butt-ends of the tubular decorative element and extending out from the cross openings in the wall thereof, and (d) decorative elements in the form of settings with stones, all decorative elements being strung on the connector, wherein all components of the set are made of precious metals or alloys thereof or plated with precious metals or alloys thereof;

wherein the tubular elements are selected from the group consisting of:

(1) tubular elements that are bent at an angle;

(2) tubular elements that are S-shaped;

(3) tubular elements that are faceted; and (4) tubular elements that are made in the form of paraboloid of revolution.

* * * * *